US008795020B2

(12) United States Patent
Lin

(10) Patent No.: US 8,795,020 B2
(45) Date of Patent: Aug. 5, 2014

(54) BUBBLE BLOWER TUBE

(71) Applicant: Shau-Chi Lin, New Taipei (TW)

(72) Inventor: Shau-Chi Lin, New Taipei (TW)

( * ) Notice: Subject to any disclaimer, the term of this patent is extended or adjusted under 35 U.S.C. 154(b) by 37 days.

(21) Appl. No.: 13/736,849

(22) Filed: Jan. 8, 2013

(65) Prior Publication Data

US 2014/0194027 A1 Jul. 10, 2014

(51) Int. Cl.
*A63H 33/28* (2006.01)
*A63H 33/00* (2006.01)

(52) U.S. Cl.
USPC ..... 446/19; 446/20

(58) Field of Classification Search
USPC ..... 446/15–21; D21/401, 402; 239/525
See application file for complete search history.

(56) References Cited

U.S. PATENT DOCUMENTS

| | | | | | |
|---|---|---|---|---|---|
| 3,183,621 | A | * | 5/1965 | Allen, Jr. | 446/19 |
| 4,166,336 | A | * | 9/1979 | Smith | 446/19 |
| 4,411,095 | A | * | 10/1983 | Rushing et al. | 446/20 |
| 5,156,564 | A | * | 10/1992 | Hasegawa | 446/15 |

* cited by examiner

*Primary Examiner* — Kien Nguyen

(57) ABSTRACT

A bubble blower tube includes a blower tube defining opposing mouthpiece and an outlet, a check valve mounted in the outlet to prohibit flowing of air or bubble fluid from the outlet toward the mouthpiece, a bubble-forming tube having a connection end connected to the periphery of the blower tube and a bubble-forming end shaped like a trumpet and suspending outside the blower tube, and a bubble fluid retaining ring located at the bubble-forming end of the bubble-forming tube and defining an outer bubble fluid retaining part and an inner bubble fluid retaining part.

2 Claims, 6 Drawing Sheets

BUBBLE BLOWER TUBE

BACKGROUND OF THE INVENTION

1. Field of the Invention

The present invention relates to bubble blowers and more particularly, to a bubble blower tube, which prohibits reverse flow of air or bubble fluid.

2. Description of the Related Art

A bubble blower tube is a tubular tool for blowing bubbles. U.S. Pat. No. 4,166,336 discloses a bubble blower entitled "Bubble forming device", which is made in the form of a funnel which is open at both ends. The small end serves as the mouthpiece, and the large end serves as the forming site for bubbles. The bubble forming end is configured so that a plane which is generally defined by the lip of the large end of the funnel extends at an acute angle to the longitudinal axis of the funnel. A film material supply surface is provided at the bubble forming end of the device. However, this design of bubble blowing device has drawbacks as follows:

1. This design of bubble blowing device is mostly used for performances. After formation of a bubble, the user must block the mouthpiece with the tongue or the hand to prevent the shaped bubble from shrinking or going to disappear, causing inconvenience to the user.

2. This design of bubble blowing device has no storage means for storing a bubble fluid and simply utilizes surface tension to let a film material supply surface be provided at the bubble forming end of the bubble blowing device, and therefore the rate and volume of bubble formation are limited.

3. The outer wall of the mouthpiece and bubble-forming end of the bubble blowing device is a continuous wall. When the bubble blowing tube is kept in vertical with the mouthpiece disposed at the bottom side of the bubble-forming end, the bubble fluid will flow downwardly from the bubble-forming end toward the mouthpiece to contaminate the user's hand or to enter the user's mouth.

SUMMARY OF THE INVENTION

The present invention has been accomplished under the circumstances in view. It is the main object of the present invention to provide a bubble blower tube, which prevents reverse flowing of air or bubble fluid.

To achieve this and other objects of the present invention, a bubble blower tube comprises a blower tube defining opposing mouthpiece and an outlet, a check valve mounted in the outlet to prohibit flowing of air or bubble fluid from the outlet toward the mouthpiece, a bubble-forming tube having a connection end connected to the periphery of the blower tube and a bubble-forming end suspending outside the blower tube, and a bubble fluid retaining ring located at the bubble-forming end of the bubble-forming tube and defining an outer bubble fluid retaining part and an inner bubble fluid retaining part.

Further, the design of the outer bubble fluid retaining part and inner bubble fluid retaining part of the bubble fluid retaining ring enhances the bubble fluid retaining ability and storage capacity of the bubble blower tube, increasing the rate and volume of bubble formation.

DETAILED DESCRIPTION OF THE PREFERRED EMBODIMENT

Figure 1:
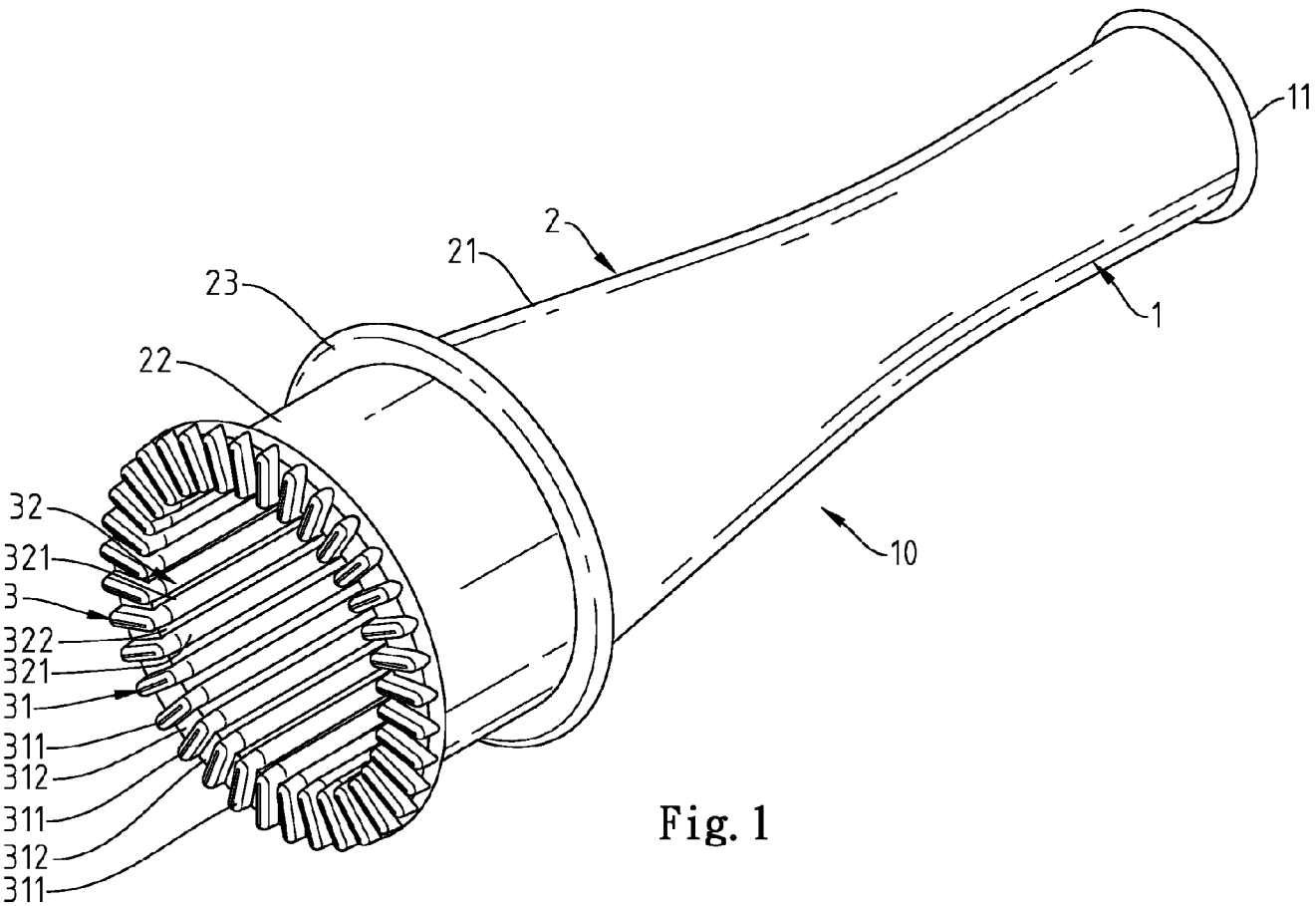
FIG. 1 is an elevational view of a bubble blower tube in accordance with the present invention.
Figure 2:
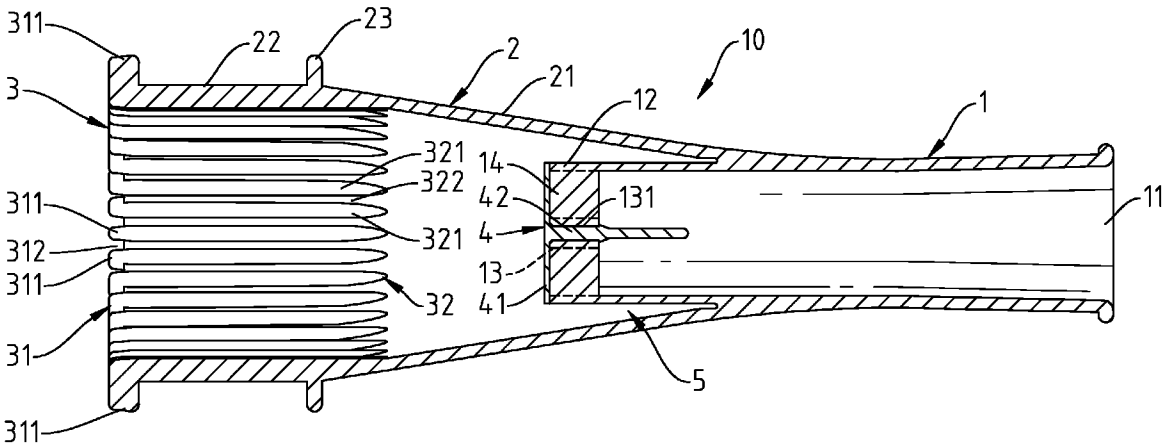
FIG. 2 is a longitudinal sectional view of the bubble blower tube in accordance with the present invention.
Figure 3:
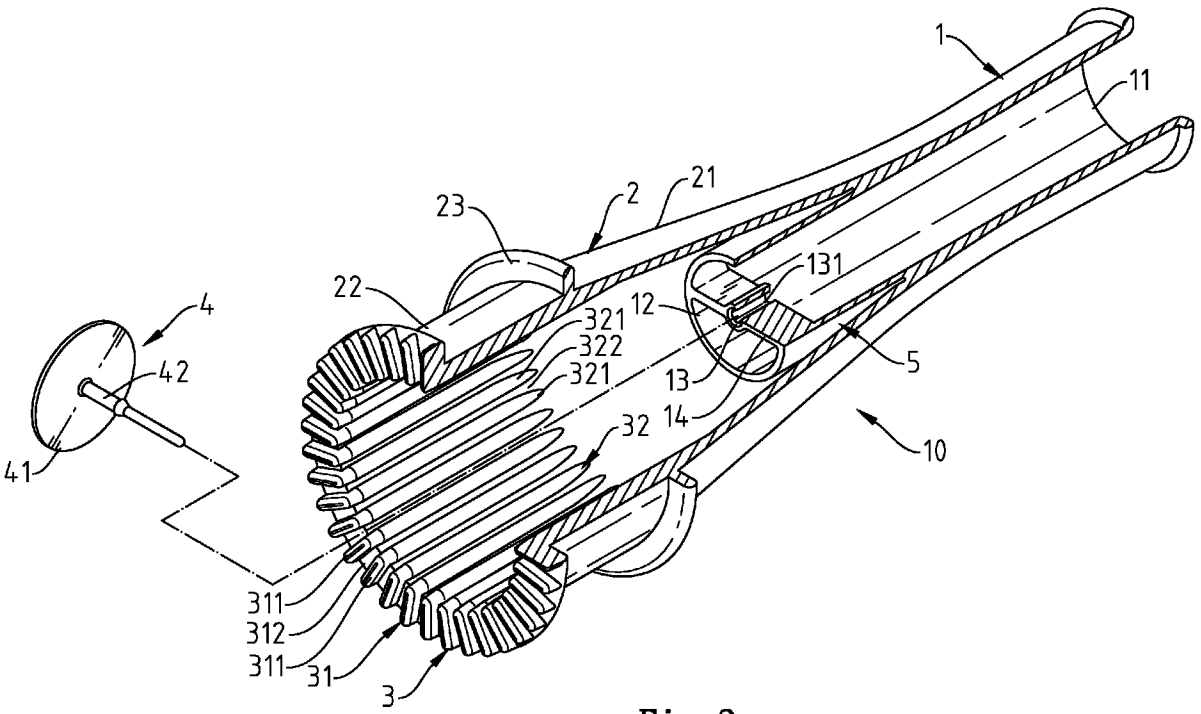
FIG. 3 is a sectional elevation of the bubble blower tube in accordance with the present invention.

Referring to FIGS. 1-3, a bubble blower tube 10 in accordance with the present invention is shown. The bubble blower tube 10 comprises a blower tube 1, a bubble-forming tube 2, a bubble fluid retaining ring 3, and a check valve 4.

The blower tube 1 comprises opposing mouthpiece 11 and air outlet 12, a positioning member 13 mounted in the air outlet 12 and defining therein a positioning hole 131, and a rack 14 connected between the periphery of the positioning member 13 and the inside wall of the air outlet 12.

The check valve 4 comprises an elastically deformable flap 41 stopped at the outlet 12 of the blower tube 1, and a positioning rod 42 perpendicularly extended from the center of the bottom wall of the deformable flap 41 positioned in the positioning hole 131 of the positioning member 13.

The bubble-forming tube 2 comprises a rear end, namely, the connection end 21 integrally connected to the periphery of the blower tube 1 in a flush manner, a front end, namely, the bubble-forming end 22 shaped like a trumpet and suspending outside the outlet 12 of the blower tube 1, a fluid storage chamber 5 defined between the outer perimeter of the outlet 12 of the blower tube 1 and the inner perimeter of the bubble-forming end 22, and an annular stop flange 23 extending around the outer perimeter thereof between the connection end 21 and the bubble-forming end 22.

The bubble fluid retaining ring 3 comprises an outer bubble fluid retaining part 31 and an inner bubble fluid retaining part 32. The outer bubble fluid retaining part 31 comprises a plurality of main bubble fluid retaining ribs 311 and main bubble fluid grooves 312 alternatively and radially arranged on the end edge of the bubble-forming end 22 of the bubble-forming tube 2. The inner bubble fluid retaining part 32 comprises a plurality of supplementary bubble fluid retaining ribs 321 and supplementary bubble fluid grooves 322 alternatively and axially arranged around the inner perimeter of the bubble-forming end 22 of the bubble-forming tube 2, wherein the supplementary bubble fluid grooves 322 are respectively connected to the main bubble fluid grooves 312.

Figure 4:
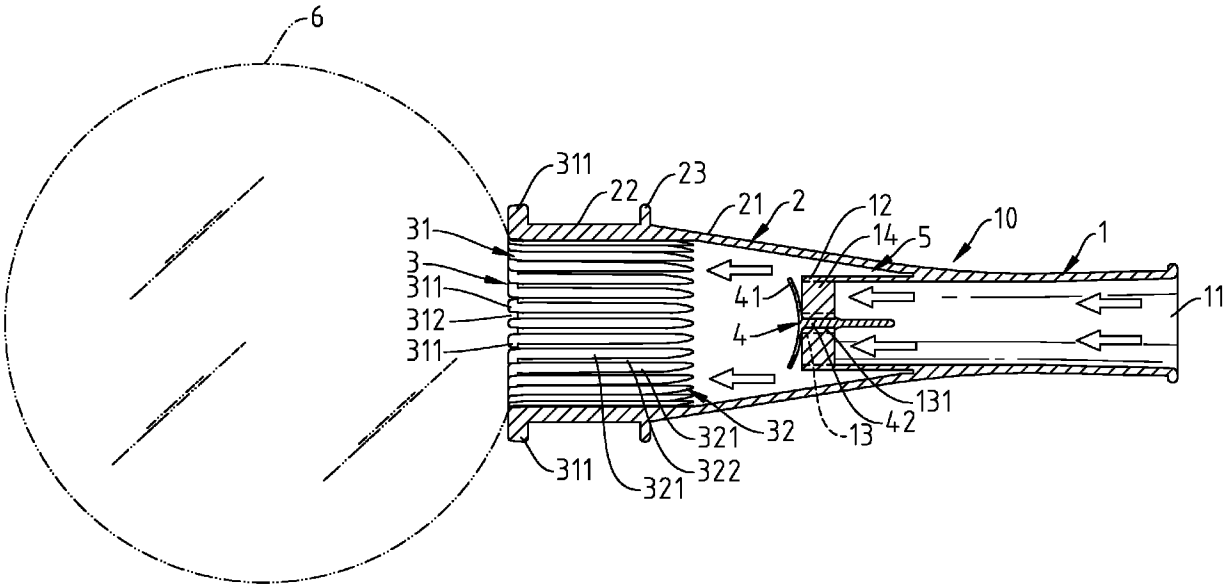
FIG. 4 is a schematic sectional applied view of the bubble blower tube in accordance with the present invention (I).
Figure 5:
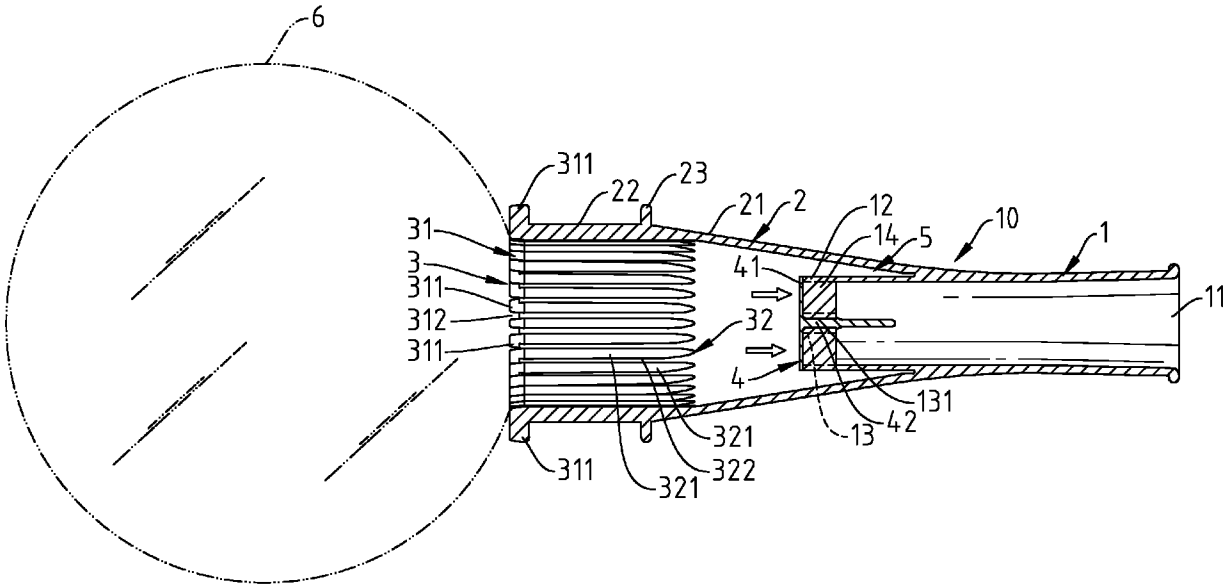
FIG. 5 is a schematic sectional applied view of the bubble blower tube in accordance with the present invention (II).

Referring to FIGS. 4 and 5 and FIG. 2 again, when using the bubble blower tube 10, dip the bubble-forming end 22 of the bubble-forming tube 2 into the bubble fluid in a bubble fluid container (not shown), enabling the main bubble fluid grooves 312 and supplementary bubble fluid grooves 322 to retain a certain amount of the bubble fluid. After removal of the bubble blower tube 10 from the bubble fluid container, the user can blow air into the mouthpiece 11 of the blower tube 1. At this time, the air flow blown by the user forces the elastically deformable flap 41 of the check valve 4 to deform elastically and to open the outlet 12. Thus, the air flow can pass through the outlet 12 into the bubble-forming tube 2 toward the bubble-forming end 22. When the air flow goes out of the bubble-forming end 22, it moves the suspended bubble fluid film in direction away from the front end edge of the bubble-forming end 22, forming a bubble 6. If the user stops blowing air into the mouthpiece 11 of the blower tube 1 before removal of the shaped bubble 6 from the bubble-forming end 22, as shown in FIG. 5, the elastically deformable flap 41 of the check valve 4 automatically returns to its former shape to close the outlet 12 of the blower tube 1, preventing the shaped bubble from shrinking or going to disappear.

Figure 6:
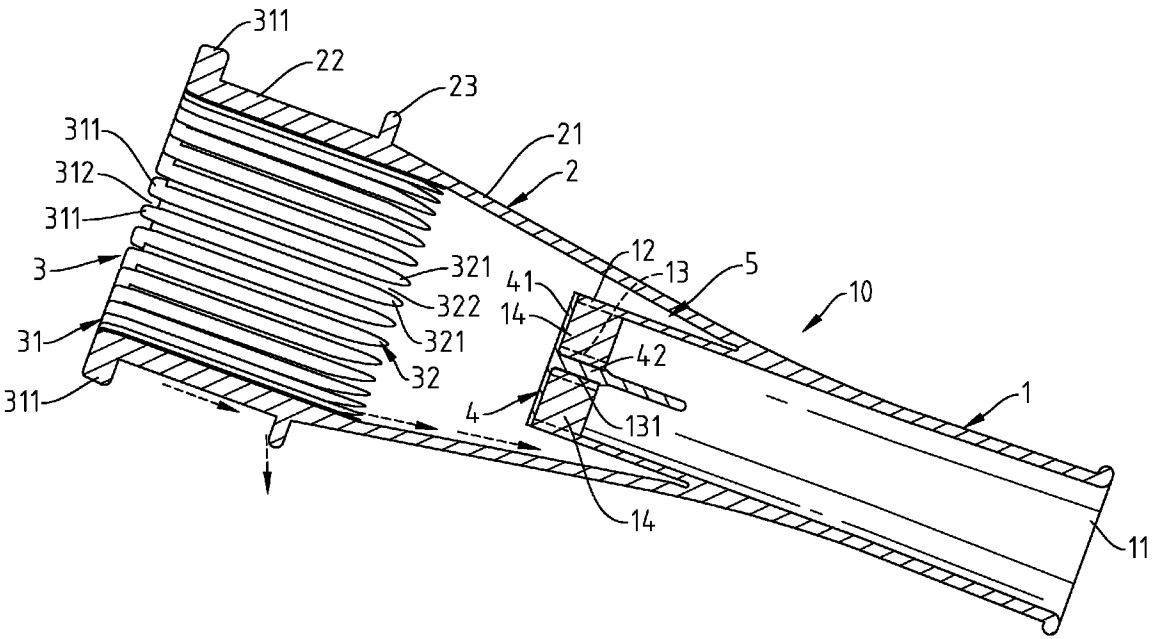
FIG. 6 is a schematic sectional applied view of the bubble blower tube in accordance with the present invention (III).

Referring to FIG. 6, when the user holds the bubble blower tube 10 in vertical to keep the bubble-forming end 22 of the bubble-forming tube 2 at the top side of the blower 1, the bubble fluid being retained at the bubble-forming end 22 will flow downwardly along the inner and outer perimeters of the bubble-forming end 22 toward the blower tube 1 subject to the force of gravity, the bubble fluid that flows downwardly along the outer perimeter of the bubble-forming end 22 will be stopped at the annular stop flange 23 and then drops from the bubble-forming tube 2 at the top side of the blower 1 without contaminating the outer perimeter of the connection end 21. Further, the bubble fluid that flows downwardly along the inner perimeter of the bubble-forming end 22 will be accumulated in the fluid storage chamber 5 and prohibited from entering the outlet 12 and mouthpiece 11 of the blower tube 1.

What the invention claimed is:

1. A bubble blower tube, comprising:

a blower tube (1) comprising a mouthpiece at one end thereof, an outlet at an opposite end thereof;

a check valve mounted in said outlet for allowing air to pass from said mouthpiece toward said outlet and prohibiting air from flowing through said outlet toward said mouthpiece;

a bubble-forming tube comprising a connection end integrally connected to the periphery of said blower tube in a flush manner, a bubble-forming end shaped like a trumpet and suspending outside said outlet of said blower tube, a fluid storage chamber defined between said outer perimeter of the outlet of said blower tube and an inner perimeter of said bubble-forming tube, and an annular stop flange extending around an outer perimeter of said bubble-forming tube between said connection end and said bubble-forming end; and a bubble fluid retaining ring comprising an outer bubble fluid retaining part and an inner bubble fluid retaining part, said outer bubble fluid retaining part comprising a plurality of main bubble fluid retaining ribs and main bubble fluid grooves alternatively and radially arranged on an end edge of said bubble-forming end of said bubble-forming tube, said inner bubble fluid retaining part comprising a plurality of supplementary bubble fluid retaining ribs and supplementary bubble fluid grooves alternatively and axially arranged around an inner perimeter of said bubble-forming end of said bubble-forming tube, said supplementary bubble fluid grooves being respectively connected to said main bubble fluid grooves.

2. The bubble blower tube as claimed in claim 1, wherein said blower tube further comprises a positioning member mounted in said outlet, said positioning member comprising a positioning hole, and a rack connected between an outer wall of said positioning member and an inner wall of said outlet; said check valve comprises an elastically deformable flap stopped at said outlet and a positioning rod perpendicularly extended from a bottom wall of said elastically deformable flap and positioned in said positioning hole.

* * * * *